US007300530B2

(12) United States Patent
Bouchette et al.

(10) Patent No.: US 7,300,530 B2
(45) **Date of Patent: *Nov. 27, 2007**

(54) PROCESS FOR PREPARING A NON-WOVEN FIBROUS WEB

(75) Inventors: Michael Paul Bouchette, Sherwood, WI (US); David Paul Kendall, Appleton, WI (US)

(73) Assignee: Appleton Papers Inc., Appleton, WI (US)

( * ) Notice: Subject to any disclaimer, the term of this patent is extended or adjusted under 35 U.S.C. 154(b) by 230 days.

This patent is subject to a terminal disclaimer.

(21) Appl. No.: 11/036,726

(22) Filed: Jan. 14, 2005

(65) Prior Publication Data

US 2005/0151287 A1 Jul. 14, 2005

Related U.S. Application Data

(60) Continuation of application No. 10/298,200, filed on Nov. 15, 2002, now Pat. No. 6,843,871, which is a division of application No. 10/001,121, filed on Nov. 2, 2001, now Pat. No. 6,517,648.

(51) Int. Cl.
*D04H 1/56* (2006.01)

(52) U.S. Cl. ..... 156/62.4; 156/167; 156/181; 156/279; 264/131; 442/417; 428/913

(58) Field of Classification Search ..... 156/62.4, 156/167, 181, 279; 264/131, 211.14; 428/913; 442/417

See application file for complete search history.

(56) References Cited

U.S. PATENT DOCUMENTS

| | | | | |
|---|---|---|---|---|
| 4,552,811 | A * | 11/1985 | Brown et al. | 428/402.21 |
| 4,990,368 | A * | 2/1991 | Johnson et al. | 427/190 |
| 5,149,468 | A * | 9/1992 | Hershelman | 264/12 |
| 5,435,376 | A * | 7/1995 | Hart et al. | 165/10 |
| 5,720,832 | A * | 2/1998 | Minto et al. | 156/62.4 |
| 6,228,492 | B1 * | 5/2001 | Kinlen et al. | 428/373 |

* cited by examiner

*Primary Examiner*—Jeff H. Aftergut
*Assistant Examiner*—Michael A Tolin
(74) *Attorney, Agent, or Firm*—Banner & Witcoff

(57) ABSTRACT

Disclosed is a fibrous web which includes a microencapsulated material, such as a microencapsulated phase change material, adhered to the web. Preferably, the web is prepared in a melt-blowing or spun-bonding process. In the melt-blowing process, cooling water containing the microcapsules is used to cool melt blown fibers prior to collection on a collector. In the spun-bonding process, microcapsules are applied in liquid suspension or in dry form to a heated web, for instance, after the web has been calendared. The fibrous webs thus prepared have numerous uses, and are particularly suited to the manufacture of clothing.

9 Claims, 3 Drawing Sheets

PROCESS FOR PREPARING A NON-WOVEN FIBROUS WEB

RELATED APPLICATIONS

This application is a Continuation of Ser. No. 10/298,200, now issued as U.S. Pat. No. 6,843,871, filed Nov. 15, 2002, and issued Jan. 18, 2005, which is a Divisional of Ser. No. 10/001,121, now U.S. Pat. No. 6,517,648, filed Nov. 2, 2001, and issued Feb. 11, 2003, for which priority is claimed. These parent applications are incorporated herein by reference in their entirety.

TECHNICAL FIELD OF THE INVENTION

The invention is in the field of processes for preparing fibrous webs. Preferred embodiments of the invention are in the field of melt-blown and spun-bonded fibrous webs.

BACKGROUND OF THE INVENTION

The prior art has provided numerous processes for preparing fibrous webs from thermoplastic materials such as polypropylene, polyethylene, polyvinyl alcohol, polylactic acid, and nylons. In many instances, fibrous webs are prepared via weaving of preformed fibers; in other instances, non-woven fibrous webs are prepared via a process such as melt blowing, spun-bonding, and melt-spinning. Innumerable variations of these processes have been provided in the prior art to produce fibrous webs suitable for use in the manufacture of many products.

Some non-woven fibrous webs are useful in the manufacture of clothing. In this regard, it has been known for some time that it is useful to incorporate a temperature stabilizing agent, such as a so-called "phase change material" or "moderate temperature phase change material," into an article of clothing to provide temperature stabilization. Moderate temperature phase change materials are substances, which undergo a change in phase at a temperature of about 60.degree.-90.degree. F. Because of the well-known thermodynamic principle that a phase change occurs at constant temperature, such materials are useful in preventing heat loss from the body as ambient temperature drops, and conversely, in preventing heat gain to the body as ambient temperature rises. Examples of the use of such moderate temperature phase changes materials are reported in numerous documents, for instance, U.S. Pat. No. 4,856,294, which purports to disclose a vest made with such phase change materials; U.S. Pat. No. 5,366,801, which purports to disclose a fabric containing microcapsules of phase change material; U.S. Pat. No. 5,415,222, which discloses a "microclimate" cooling garment comprising a vest which contains a "macroencapsulated" phase change material contained within a honeycomb structure, and U.S. Pat. No. 6,120,530, which purports to disclose a passive thermocapacitor for cold water diving garments.

Known moderate temperature phase change materials are conveniently provided in microencapsulated form. The microcapsules of phase change material may be secured to a substrate with the use of a binder, as is purportedly taught in a number of prior patents, including U.S. Pat. Nos. 5,955,188; 6,077,597; and 6,217,993. Alternatively, in the preparation of a fibrous substrate, the microcapsule may be dispersed within a polymeric melt, and fibers may be blown or otherwise prepared from the melt, as is purportedly taught in U.S. Pat. No. 4,756,958. Both of these prior art approaches suffer from a number of drawbacks. Although microcapsules can be secured to a substrate with a binder, this approach is unsatisfactory, because it is believed that microcapsules are susceptible to being debound upon washing or wear of the fabric thus made. Moreover, while in theory these problems are mitigated by incorporating microcapsules into the polymeric melt used to prepare the fibers, it is believed that in practice the microcapsule chemistry is incompatible with the temperatures required to process many thermoplastic polymers. In particular, it is believed difficult to obtain non-woven nylon or polypropylene fabric using such techniques.

It is a general object of the invention to provide, at least in preferred embodiments, a process for incorporating moderate temperature phase change materials into non-woven fibrous webs that is different from the processes heretofore described. In highly preferred embodiments, the invention has as an object to provide nylon and polypropylene non-woven fibrous webs that incorporate microencapsulated materials, and in particular microencapsulated moderate temperature phase change materials.

THE INVENTION

It is now been found that an adherent, such as a microencapsulated moderate temperature phase change material, can be incorporated into a non-woven web during a melt-blowing or a spun-bonding manufacturing process. In the melt-blowing operation, fibers are melt-blown from a polymer melt of a thermoplastic polymer. After the fibers are formed, they remain at an elevated temperature for short period of time, during which time the fibers remain tacky. In accordance with the invention, the adherent is caused to be contacted with the fibers while they are in the tacky state to cause the adherent to adhere to the fibers. In conventional melt-blowing operations, the tacky fibers are cooled with a cooling spray, which comprises a cooling fluid (typically water). In accordance with the preferred embodiment of the invention, the microencapsulated phase change material or other adherent is provided as a suspension in this cooling spray. After the hot fibers have been cooled with the cooling fluid, the fibers are collected to thereby form a fibrous web.

The invention also contemplates other web forming operations, such as spun-bonding. In a typical spun-bonding operation, fibers exit a spinarette and travel as a body to a subsequent heating stage, at which the fibrous body is heated to enhance interfiber cohesion. Most typically, the body of fibers is heated via a hot calendar or embossing roll. After exiting the heating stage, the body of fibers is tacky, and the adherent can be then caused to be contacted with the body of fibers to thereby cause adherence to the body. Even more generally, a preformed body of fibers can be heated and contacted with an adherent, which may be a microencapsulated moderate temperature phase change material or other temperature stabilizing agent, or, more generally, any other microencapsulated material, to cause the adherent to adhere to the body of fibers.

Other features and embodiments of the invention are discussed hereinbelow and in the appended claims.

DESCRIPTION OF THE PREFERRED EMBODIMENTS

Figure 1:
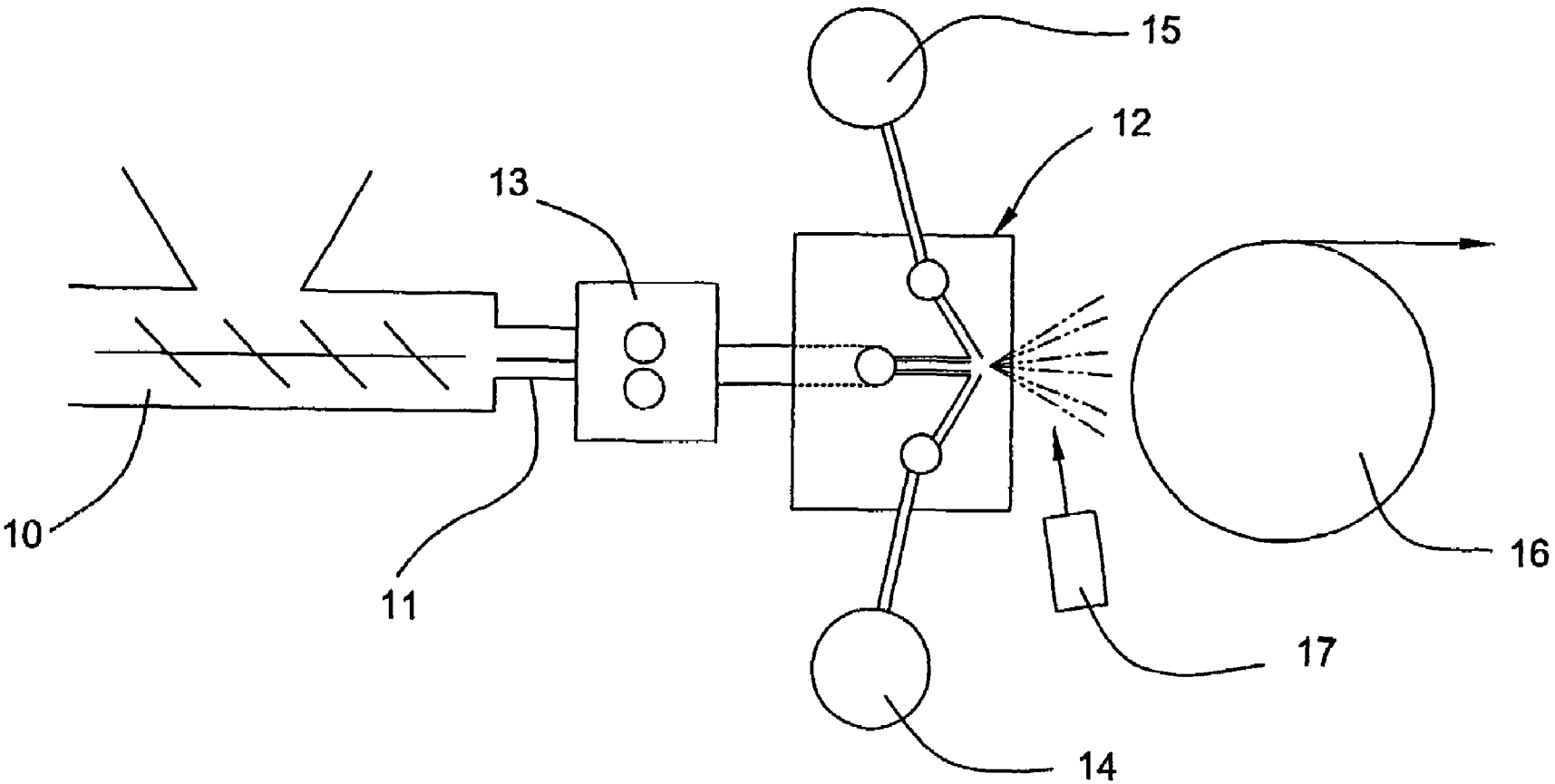
FIG. 1. is a representation of a melt-blowing operation useful in conjunction with the practice of the present invention.

The invention is applicable to the preparation of non-woven fibrous webs from a variety of polymeric melts. Polymers suitable for use in conjunction with invention include polyvinyl alcohol, polylactic acid, polypropylene, nylons (such as nylon 6, nylon 6-6, nylon 612, nylon 11) and so forth. Other suitable thermoplastic polymers include polybutylene terephthalate, polyethylene terephthalate, poylmethylpentene, polycholorotrifluoroethylene, poylphenylsulfide, poly(1,4-cyclohexylenedi-methylene)terephthalate, polyesters polymerized with an excess of glycol, copolymers of any of the foregoing, and the like. Generally, any thermoplastic polymer suitable for use in the preparation of fibrous webs may be used in conjunction with the invention.

The invention in preferred embodiments contemplates the preparation of fibrous webs having microencapsulated material incorporated therewith, which materials preferably are microencapsulated moderate temperature phase change materials. Numerous suitable moderate temperature phase change materials have been described in the art; example of such materials include n-docosane, n-eicosane, n-heneicosane, n-heptacosane, n-heptadecane, n-hexacosane, n-hexadecane, n-nonadecane, n-octacosane, n-octadecane, n-pentacosane, n-pentadecane, n-tetracosane, n-tetradecane, n-tricosane, and n-tridecane. More generally, any material that undergoes a change in phase at a desired temperature or within a useful temperature range (not necessarily 60.degree.-90.degree. F.) or other temperature stabilizing agent suitable for use in conjunction with the invention may be employed therewith. For instance, it is contemplated that non-microencapsulated temperature stabilizing agents may be employed in conjunction with the invention. Certain plastic materials such as 2,2-dimethyloyl-1,3-propanediol and 2-hydroxymethyl-2-methyl-1,3-propandi-ol and the like are said to have temperature stabilizing properties. When crystals of the foregoing absorb thermal energy, the molecular structure is temporarily modified without changing the phase of the material. Such other temperature stabilizing agents may be employed in connection with the invention.

The microencapsulated material may be provided in any suitable microcapsule dimension and using any suitable capsule chemistry. The microcapsule preferably is small relative to the diameter of the fibers in the substrate. The microcapsules generally range in nominal diameter from about 1.mu. to about 100.mu., but in the melt-blowing embodiments of the invention preferably are provided in the range of about 1.mu. to about 4.mu. In other embodiments, particularly spun-bonding, large microcapsules may be employed; preferably, these microcapsules range to about 8.mu. in diameter. Nominal capsules sizes typically represent the approximate size of 50-70% by volume of the total range of capsules produced. In the present invention, the microcapsules employed had a nominal 4.mu. dimension, and the actual reserved measured target size portion of the microcapsule mix was close to 90% of the total mixture.

The capsule walls preferably are sufficiently thick to avoid rupture when the processed in accordance with the present teachings. Those skilled in the art will appreciate that the capsule size and wall thickness may be varied by many known methods, for instance, adjusting the amount of mixing energy applied to the materials immediately before wall formation commences. Capsule wall thickness is also dependent upon many variables, including primarily the mixing blade geometry and blade rpm. In the examples which follow, the capsule wall represented 10-12% of the capsule weight.

With respect to the chemistry of the microcapsules, the microcapsules generally comprise a microencapsulated material contained within a wall bounded by a wall material, the wall material preferably comprising a polyacrylate wall material, as described in, for instance, U.S. Pat. No. 4,552,811. Gelatin capsules, such as those described in U.S. Pat. Nos. 2,730,456; 2,800,457; 2,800,457; and 2,00,458, and gel-coated capsules, as purportedly described in U.S. Pat. No. 6,099,894 further may be employed in connection with the invention.

The microcapsules may be prepared by any suitable means, for instance, via interfacial polymerization. Interfacial polymerization is a process wherein a microcapsule wall of a polyamide, an epoxy resin, a polyurethane, a polyurea or the like is formed at an interface between two phases. U.S. Pat. No. 4,622,267 discloses an interfacial polymerization technique for preparation of microcapsules. The core material is initially dissolved in a solvent and an aliphatic diisocyanate soluble in the solvent mixture is added. Subsequently, a nonsolvent for the aliphatic diisocyanate is added until the turbidity point is just barely reached. This organic phase is then emulsified in an aqueous solution, and a reactive amine is added to the aqueous phase. The amine diffuses to the interface, where it reacts with the dissocyanate to form polymeric polyurethane shells. A similar technique, used to encapsulate salts which are sparingly soluble in water in polyurethane shells, is disclosed in U.S. Pat. No. 4,547,429. U.S. Pat. No. 3,516,941 teaches polymerization reactions in which the material to be encapsulated, or core material, is dissolved in an organic, hydrophobic oil phase which is dispersed in an aqueous phase. The aqueous phase has dissolved materials forming aminoplast resin which upon polymerization form the wall of the microcapsule. A dispersion of fine oil droplets is prepared using high shear agitation. Addition of an acid catalyst initiates the polycondensation forming the aminoplast resin within the aqueous phase, resulting in the formation of an aminoplast polymer, which is insoluble in both phases. As the polymerization advances, the aminoplast polymer separates from the aqueous phase and deposits on the surface of the dispersed droplets of the oil phase to form a capsule wall at the interface of the two phases, thus encapsulating the core material. This process produces the microcapsules. Polymerizations that involve amines and aldehydes are known as aminoplast encapsulations. Urea-formaldehyde (UF), urea-resorcinol-formaldehyde (URF), urea-melamine-formaldehyde (UMF), and melamine-formaldehyde (MF) capsule formations proceed in a like manner. In interfacial polymerization, the materials to form the capsule wall are in separate phases, one in an aqueous phase and the other in a fill phase. Polymerization occurs at the phase boundary. Thus, a polymeric capsule shell wall forms at the interface of the two phases thereby encapsulating the core material. Wall formation of polyester, polyamide, and polyurea capsules proceeds via interfacial polymerization.

Gelatin or gelatin-containing microcapsule wall materials are well known. The teachings of the phase separation processes, or coacervation processes, are described in U.S. Pat. Nos. 2,800,457 and 2,800,458, Uses of such capsules are described in U.S. Pat. No. 2,730,456.

More recent processes of microencapsulation involve the polymerization of urea and formaldehyde, monomeric or low molecular weight polymers of dimethylol urea or methylated dimethylol urea, melamine and formaldehyde, monomeric or low molecular weight polymers of methylol melamine or methylated methylol melamine, as taught in U.S. Pat. No. 4,552,811. These materials are dispersed in an aqueous vehicle and the reaction is conducted in the presence of acrylic acid-alkyl acrylate copolymers. Preferably, the wall forming material is free of carboxylic acid anhydride or limited so as not to exceed 0.5 weight percent of the wall material.

Other microencapsulation methods are known. For instance, a method of encapsulation by a reaction between urea and formaldehyde or polycondensation of monomeric or low molecular weight polymers of dimethylol urea or methylated dimethylol urea in an aqueous vehicle conducted in the presence of negatively-charged, carboxyl-substituted, linear aliphatic hydrocarbon polyelectrolyte material dissolved in the vehicle, is taught in U.S. Pat. Nos. 4,001,140; 4,087,376; and 4,089,802. A method of encapsulating by in situ polymerization, including a reaction between melamine and formaldehyde or polycondensation of monomeric or low molecular weight polymers of methylol melamine or etherified methylol melamine in an aqueous vehicle conducted in the presence of negatively-charged, carboxyl-substituted linear aliphatic hydrocarbon polyelectrolyte material dissolved in the vehicle is disclosed in U.S. Pat. No. 4,100,103. A method of encapsulating by polymerizing urea and formaldehyde in the presence of gum arabic is disclosed in U.S. Pat. No. 4,221,710. This patent further discloses that anionic high molecular weight electrolytes can also be employed with gum arabic. Examples of the anionic high molecular weight electrolytes include acrylic acid copolymers. Specific examples of acrylic acid copolymers include copolymers of alky acrylates and acrylic acid including methyl acrylate-acrylic acid, ethyl acrylate-acrylic acid, butyl acrylate-acrylic acid and octyl acrylate-acrylic acid copolymers. Finally, a method for preparing microcapsules by polymerizing urea and formaldehyde in the presence of an anionic polyelectrolyte and an ammonium salt of an acid is disclosed in U.S. Pat. Nos. 4,251,386 and 4,356,109. Examples of the anionic polyelectrolytes include copolymers of acrylic acid. Examples include copolymers of alkyl acrylates and acrylic acid including methyl acrylate-acrylic acid, ethyl acrylate-acrylic acid, butyl acrylate-acrylic acid and octyl acrylate-acrylic acid copolymers.

Other microencapsulation processes known in the art or otherwise found to be suitable for use with the invention may be employed. More generally, the adherent may be provided in a form other then microcapsules, such as the "macrocapsules" discussed in U.S. Pat. No. 5,415,222. Moreover, whether microencapsulated or provided in a different form, the material to be adhered to the fibrous web is not limited to phase change materials, and it is contemplated that, for instance, microencapsulated colorants and fragrances, and conceivably other materials, could be incorporated onto the fibrous web.

In accordance with the invention, discrete plural particles of adherent, such as but not limited to the foregoing materials, are caused to adhere to fibers in a fibrous web. The preferred embodiments of the invention are practiced during the formation of the web in a melt-blowing or spun-bonding process. As discussed above, there are innumerable such processes known in the art. Except for the step of adhering the phase change material or other adherent to the web, the process of the invention may be a conventional process, or other process as may be suitable for use in conjunction with the invention.

With reference to the melt-blowing operation depicted in FIG. 1, the polymer melt is delivered from a feeder (not shown) to an extruder 10. From the extruder, the melt is delivered through conduit 11 to a die 12 by means of gear pump 13. The polymer melt is extruded through the die 12 to form fibers, which are formed by blowing through the die 12. Air is delivered through air manifolds 14, 15. Before being collected on a collector 16, the blown fibers are cooled with a cooling fluid delivered from a sprayer 17. The cooling fluid typically water, and, in accordance with the invention, comprises a suspension of water and the adherent. In other embodiments, the cooling fluid could be air (it is even contemplated that heated air, which would serve to retard cooling oil but which would allow more time for capsule adhesion, could be employed). The melt-blowing operation depicted in FIG. 1 is highly idealized, and in practice the operation and apparatus may comprise other steps and components respectively. For instance the capsule and fluid could be applied separately. While those skilled in the art would appreciate and understand the various parameters that affect the melt-blowing, it should here be noted that some of the parameters that may affect the melt-blowing process include the distance between the die and collector (i.e., the die-collector distance, or DCD), the distance between the cooling fluid spray head and the body of fibers blown from the die, the number of individual dies in the die manifold, the angle of impingement of the cooling spray onto the body of fibers, whether the spray is directed toward or away from the die manifold, the geometry of the spray of cooling fluid (e.g., whether the spray is conical or nearly linear) and the temperature of the cooling fluid. Preferably, the operation is such that the body of fibers is at least substantially permeable to cooling fluid, such that the adherent permeates the body of fibers and adheres to fibers within the body. Other melt-blowing embodiments are possible; for instance, the adherent may be applied in dry form contemporaneously with the application of cooling fluid.

Figure 2:
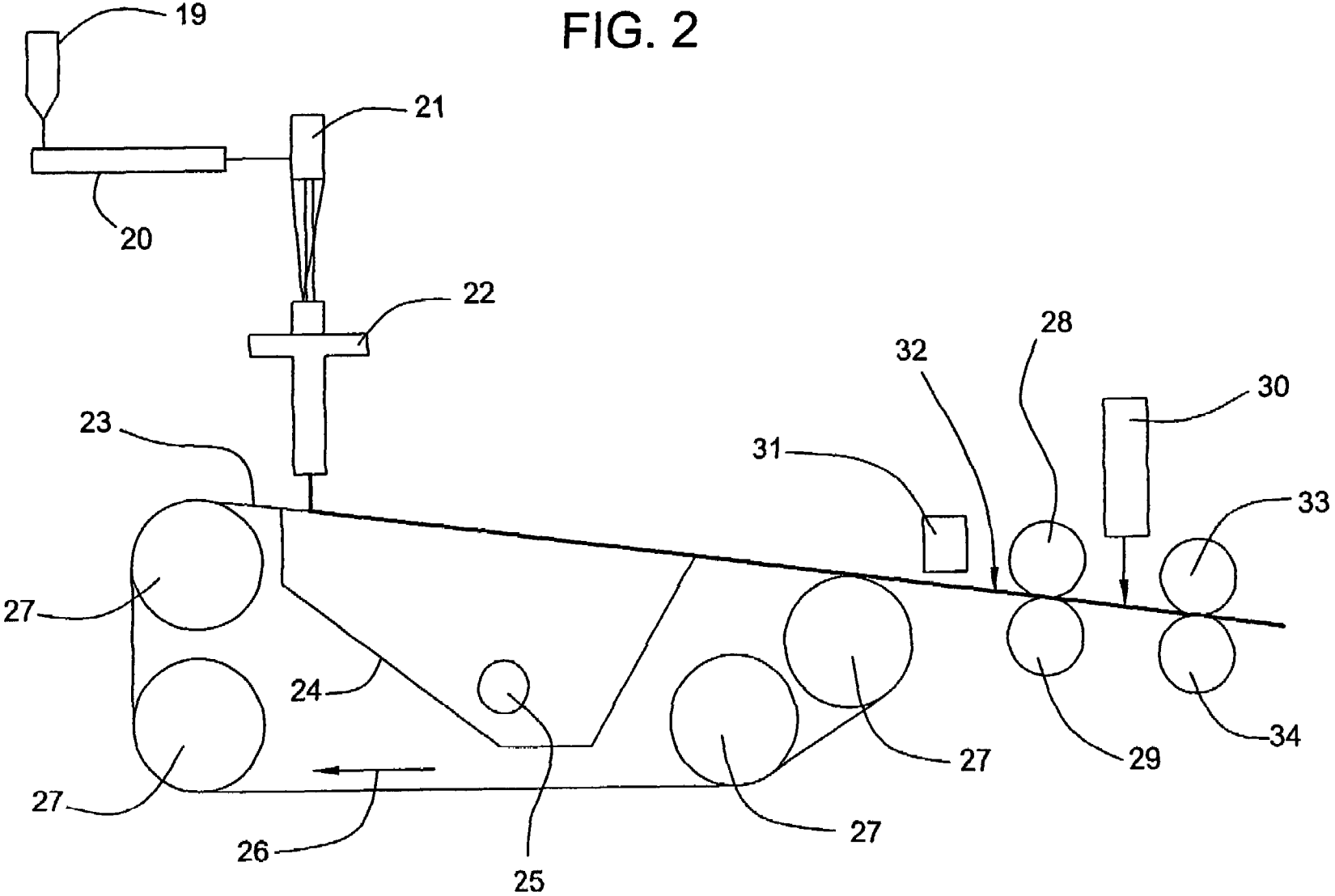
FIG. 2. is a representation of a spun-bonding operation useful in conjunction with the practice of the invention.

With reference now to the spun-bonding operation depicted in FIG. 2, the melt passes from a resin feeder 19 and through an extruder 20 into a spinarette 21 (one is shown for convenience but in fact multiple spinarettes may be combined into one or more spinpaks). Fibers exiting the spinarette 21 enter a fiber attenuator/randomizer 22 and exit as a spun bond web onto a forming wire 23. In the illustrated embodiment, suction is applied at suction box 24 with air exiting through aperture 25, and the forming wire 23 travels in a continuous loop in direction of arrow 26 over rollers 27. Upon exiting the suction box 24, the spun-bond webs has cooled to a point where the fibers that comprise the web are not tacky, or are only very slightly tacky. The web next passes through a hot nip operation, which, in the illustrated embodiment, is conducted via pair of calendar rollers 28, 29, at least one of which is a hot calendar. The hot nip alternatively may be accomplished via an embossing roller or other suitable device. Upon exiting the rollers, the fibers of the web are hot and tacky. At this point, the adherent is applied. When the adherent comprises a microencapsulated product, the adherent is preferably in dry form, and is "dusted" onto the web in via a dry capsule spraying device 30. Once again, FIG. 2 depicts an idealized process, and in practice, numerous operating parameters may be adjusted, and steps may be removed or added. For instance, an optional preheater 31 may be employed, and, in this embodiment, the capsules spray device may be employed in position 32. Additional heated rollers 33, 34 may be employed for further heating steps. More generally, any suitable technique may be employed. For instance, instead of heating via a hot nip operation, the fibers may be heated via irradiation from a source of radiant heat or via hot gasses.

Figure 3:
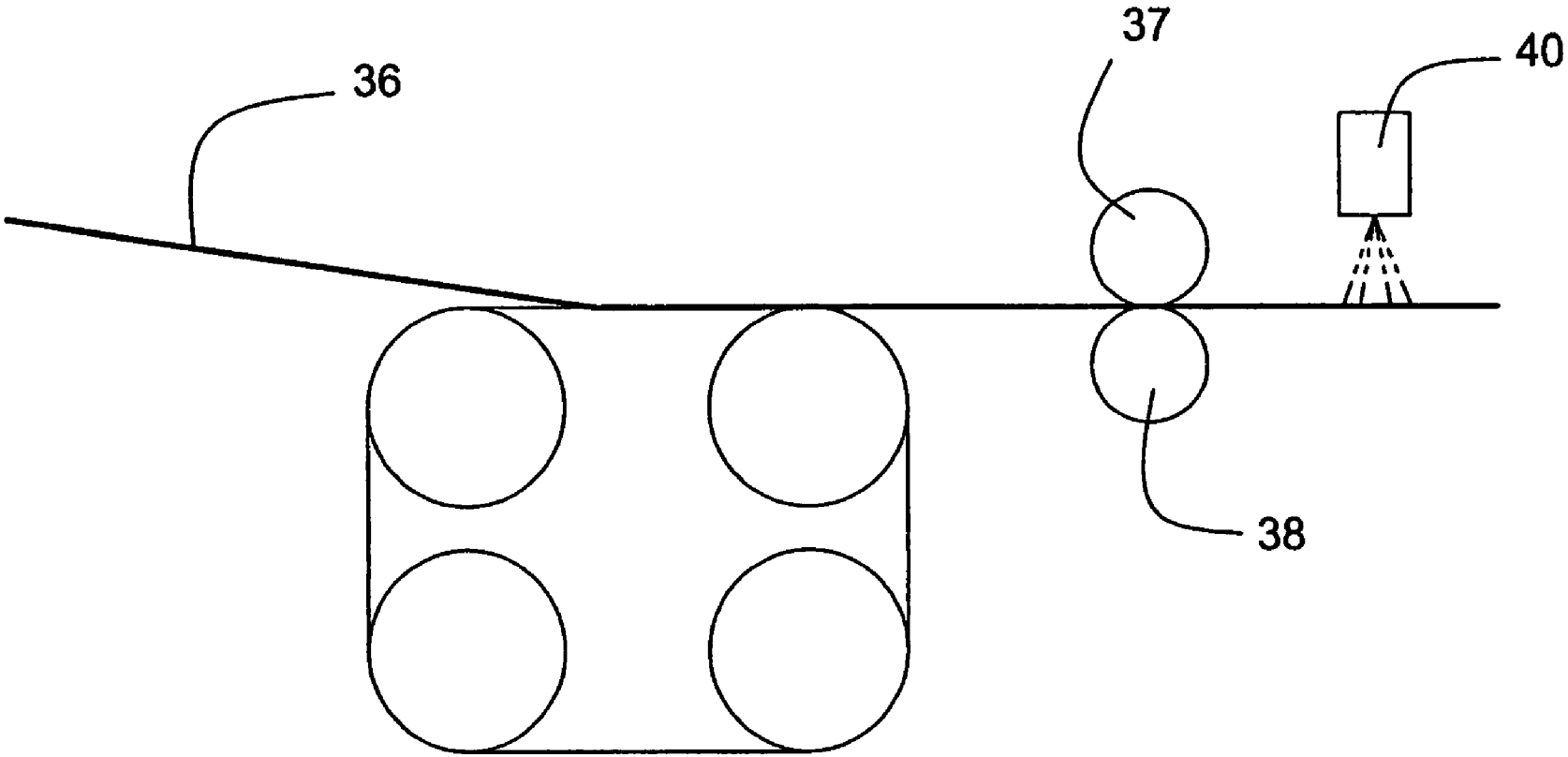
FIG. 3. is a representation of a process for adhering a microencapsulated material to a preformed non-woven fibrous web.

With reference now to FIG. 3, in this embodiment of the invention a performed web 36 is heated, preferable using calendar rollers 37, 38, to a temperature at which the fibers in the web are tacky. The heated body of fibers is then dusted with a microencapsulated material or another form of temperature stabilizing agent via delivery device 40. Again, the operation depicted in FIG. 3 is highly idealized, and those skilled in the art will find innumerable variants of the forgoing process.

The fibrous web prepared in accordance with the invention is suitable for use in the preparation of fabrics, which can be used for the manufacture of clothing, including hats, vests, pants, scarves, jackets, sweaters, gloves, socks, and so forth, and also can be used in connection with the preparation of other material, such as upholstery for outdoor furniture. The invention should not be deemed limited to the foregoing applications, however, and indeed it is contemplated that to the contrary the fibrous webs prepared in accordance with the invention will find numerous other uses.

The following examples are provided to illustrate the present invention. The examples should not be construed as limiting the scope of the invention.

Capsule Formation

A water phase component consisting of 23.9 g alkyl acrylate acrylic acid copolymer, 17.9 g 5% NaOH, and 152.6 g water is prepared and heated to 65.degree. C. In a separate vessel, 266.9 g of n-octadecane are heated to 70.degree. C. The water phase component is added to a blender with temperature control set to 65.degree. C. and mixed at low speed. Alkylated melamine formaldehyde (such as etherified methylol melamine), 3.8 g, are slowly added to the blender. After approximately 20 minutes of additional blending, 266.9 g n-octadecane are added slowly with stirring. The ingredients are mixed on a high setting for about 30 minutes.

In a separate container, 22.2 g of the alkyl acrylate acrylic acid copolymer, 5.2 g 5% NaOH, and 40.1 g water are mixed with a magnetic stirrer. After about 25 minutes of mixing, 23.5 g alkylated melamine formaldehyde are added to the blend, and mixed for another 5 minutes.

The two solutions are blended at low speed. Three g Na.sub.2SO.sub.4 are added and heated with stirring at 65.degree. C. for 8.5 hours.

This mixture is allowed to then cool to room temperature, and neutralized with NH.sub.4OH to a pH of 8.2 to 8.5. Water is added to a final solution weight of 550 g.

EXAMPLE 1

Polypropylene Web

This example illustrates the preparation of a polypropylene web with polyacrylate microcapsules containing n-octadecane disposed thereon.

Microcapsules of approximately 4.mu. in diameter were suspended in water at a solids level of 50%. The product was introduced in to a reservoir, serviced by a CAT pump, model 270 (max. vol. 3.5 gal/min, max pressure 1500 psi). The pump fed the capsules into a spray manifold consisting of nine nozzles in a bank, each nozzle being rated at 0.4 gal/hr at 100 psi. The melt blowing apparatuses used was a 20 in. pilot line made by Accurate Products. The extrusion die had 501 holes, with hole diameters of 0.0145 in. The unit had 4 barrel zone extruders (melt chambers), and 5 die zone temperature regulators. Three hot air furnace were used to generate the hot air used in the extrusion. The Air Gap and Set Back settings (for the introduction of hot air at the die extrusion tips) were both 0.030 in. The melt blown web exited the manifold in horizontal mode, traveling across a dead space to a collector which comprised a wind-up reel. The quench spray manifold was located approximately 15 in. below the exiting web, and the spray angle could be adjusted to hit the web straight on (i.e., vertical), or at an angle away from the web or towards the manifold. The vertical height (i.e., the distance from the web) also could be adjusted. Pump spray pressures were held constant at about 400 psi.

The barrel zone extruder temperature, the die zone temperature, and the air furnace temperature were each set at 480.degree. F. Air pressure at the die extrusion tips was 3 psi, and the DCD was 10 in. Flow rate per hole was estimated at 0.4 g/min. A line speed of 29 ft/min was used. An initial sample was run without quenching. The final basis weight of the web was predicted to be 44.63 g/m.sup.2. The actual measured basis weight of the final sample was 24.8 g/m.sup.2. The reason for the discrepancies between the predicted and actual basis weights is not understood.

For the first example, a quench spray comprising a 50% microcapsule suspension was introduced at a spray angle of about 15 to 20.degree. towards the take up reel. It became quickly visible evident that the efficiency of capsule spraying was low. The visible mist of capsules being sprayed did not appear to follow the direction of the web, and much overspray was noted on floor and surrounding equipment. The predicted basis weight of the capsule-containing product was estimated to 72.66 g/m.sup.2, while the actual measure basis weight of the final product was only 24.5 g/m.sup.2, approximately the same as the untreated control. SEM photographs confirmed that a few capsules did adhere to the web.

EXAMPLE 2

Polypropylene Web

A polypropylene web was prepared as per example 1, except that the angle of the spray manifold was changed to about 10-15.degree. towards the extrusion manifold. An attempt was made to spray the cooling fluid as close as possible to the exit point of the fibers from the extrusion manifold, while trying to minimize the spray that actually contacted the manifold. It was readily apparent that this modification significantly improved the capsule adhesion. Visible overspray was virtually eliminated, and the spray mist could actually be seen to follow the web. The predicted final basis weight was 72.66 g/m.sup.2, while the final measured basis weight was 27.3 g/m.sup.2. While the discrepancy between the predicted and final basis weight is not well understood, it was noted that the weight of the capsules increased the weight of the web by about 10% over the final weight measured in Example 1. SEM photographs provided visual confirmation of significant capsule adhesion.

EXAMPLE 3

Polypropylene Web

A polypropylene web was prepared as per Example 1, except the line speed was decreased to 14 fpm to increase the dwell time of the web in the capsule spray mist. The predicted untreated web weight was calculated to be 92.4 g/m.sup.2, while the actual final basis weighted was 44.9 g/m.sup.2. Again, this discrepancy is not well understood.

For the example, the capsule spray was introduced, with the spray manifold used in a position of 10-15.degree. off vertical toward the extrusion manifold. The predicted final basis weight of the product was calculated to be 150.51 g/m.sup.2. The actual basis weight of the web was 52.7 g/m.sup.2. Thus, although the discrepancy between predicated and actual basis weights is not well understood, the weight of the web increased by 17% via the addition of the capsules. SEM photographs provided visual confirmation of the capsule adhesion.

EXAMPLE 4

Nylon Web

In this example, a nylon 6 web was prepared. It was believed that nylon 6 was a more "sticky" polymer then polypropylene, and that capsule addition would therefore be enhanced.

The barrel zone extruder temperature, the die zone temperature, and the air furnace temperature were all raised to 580.degree. F. The DCD was increased to 17 in., and the hole flow rates were decreased to 0.26 gal/hr. The air pressure at the extrusion tips was increased to 4 psi.

An untreated nylon web was prepared at a line speed of 14 ft/min. The predicted base weight of the web was estimated to be 60.1 g/m.sup.2, which is in good agreement with the actual measured basis weight of 58.4 g/m.sup.2.

For the example, the line speed was increased to 29 fpm. It was believed that the increase in line speed decreased the basis weight of the web. The predicted basis weight for the untreated was 29.4 g/m.sup.2, while the predicted basis weight for the capsule-containing web was 57.04 g/m.sup.2, which was in good agreement with the actual measured basis weight of 61.5 g/m.sup.2. It was believed that the addition of the capsules increased the weight of the base web by approximately 100% over the predicted untreated value. SEM photographs revealed a very good distribution of capsules in the web, and a substantial increase in adhesion over the polypropylene webs of the previous examples. It was further noted that capsules appeared to be uniformly distributed throughout the web. Additional SEM photographs were taken on the side of the web opposite the side contacted by the capsule spray; these appeared to be virtually identical to the SEM photographs taken on the treated side of the web.

A sample of the web was immersed in a water bath and very gently agitated, removed, and allowed to dry. Some capsules were evident in the rinse water, but a subsequent SEM photograph showed no significant reduction in the amount of capsules present on the washed web.

EXAMPLE 5

Nylon Webs

Example 4 was repeated, except that the capsule suspension spray heads were cleaned. No significant difference was seen in the basis weight of the final product or in the SEM photographs.

EXAMPLE 6

A polypropylene web is prepared in a spun-bonding process. After the web has been formed, it is passed through a pair of heated calendar rollers. Upon exiting the calendar rollers, dry polyacrylate microcapsules containing n-octadecane are dusted onto the web.

EXAMPLE 7

A polypropylene web is provided. The web is heated between a pair of hot calendar rollers. Dry capsules of n-octadecane are dusted on to the web after the web exits the calendar rollers.

Thus, it is seen that the foregoing general object has been satisfied. The invention provides processes for preparing fibrous webs having microencapsulated materials adhered thereto.

While particular embodiments of the invention have been described, the invention should not be deemed limited thereto. Instead, the scope of the patent should be defined by the appended claims. All references cited herein are hereby incorporated by reference in their entireties.

What is claimed is:

1. A process for preparing a fibrous web, comprising:

providing a polymeric melt comprising a thermoplastic polymer;

melt-blowing a body of fibers from said melt, said body comprising a plurality of fibers, said fibers being at a temperature sufficient to render said fibers tacky;

contacting said body with discrete plural particles of an adherent suspended in a liquid medium, whereby at least some of said particles adhere to said body; and collecting said body on a collector thereby forming a web.

2. A process according to claim 1, said polymeric melt comprising a polymer selected from the group consisting of polypropylene, polyethylene, polyvinyl alcohol, and polylactic acid.

3. A process according to claim 2, said polymeric melt comprising polyethylene.

4. A process according to claim 1, said polymeric melt comprising a nylon.

5. A processing according to claim 1, said adherent comprising a temperature stabilizing agent.

6. A process according claim 5, said temperature stabilizing agent comprising a microencapsulated moderate temperature phase change material.

7. A process according claim 6, said phase change material being selected from the group consisting of n-docosane, n-eicosane, n-heneicosane, n-heptacosane, n-heptadecane, n-hexacosane, n-hexadecane, n-nonadecane, n-octacosane, n-octadecane, n-pentacosane, n-pentadecane, n-tetracosane, n-tetradecane, n-tricosane, and n-tridecane.

8. A process according claim 6, said microcapsules comprising a moderate temperature phase change material contained within a polyacrylate wall material.

9. A process for preparing a fibrous web, comprising:

providing a polymeric melt comprising a thermoplastic polymer;

melt-blowing a body of fibers from said melt, said body comprising a plurality of fibers, said fibers being at a temperature sufficient to render said fibers tacky;

contacting said body with discrete plural particles of an suspended in a liquid medium adherent, whereby at least some of said particles adhere to said body, the adherent comprising a phase change material which undergoes a phase change at a temperature in the range of from about 60° F. to about 90° F.; and collecting said body on a collector thereby forming a web.

* * * * *